US007146647B2

(12) United States Patent
Krause et al.

(10) Patent No.: US 7,146,647 B2
(45) **Date of Patent: *Dec. 12, 2006**

(54) EXPANDABLE, NO-SHRINK SHIRT COLLAR

(76) Inventors: Arthur A. Krause, 20539 Archwood St., Winnetka, CA (US) 91306; Walter K. Lim, P. O. Boc 2409, Rancho Santa Fe, CA (US) 92067-2409

( * ) Notice: Subject to any disclaimer, the term of this patent is extended or adjusted under 35 U.S.C. 154(b) by 767 days.

This patent is subject to a terminal disclaimer.

(21) Appl. No.: 10/071,927

(22) Filed: Feb. 7, 2002

(65) Prior Publication Data

US 2002/0120974 A1 Sep. 5, 2002

Related U.S. Application Data

(63) Continuation-in-part of application No. 09/783,853, filed on Feb. 15, 2001, now Pat. No. 6,477,713, which is a continuation-in-part of application No. 09/366,681, filed on Aug. 4, 1999, now Pat. No. 6,212,686, which is a continuation-in-part of application No. 09/172,358, filed on Oct. 14, 1998, now Pat. No. 6,081,926.

(51) Int. Cl.
*A41B 3/00* (2006.01)

(52) U.S. Cl. ..... 2/129; 2/130

(58) Field of Classification Search ..... 2/129, 2/130, 133, 98, DIG. 4, 113–115, 105, 106, 2/69, 85, 93, 94, 95
See application file for complete search history.

(56) References Cited

U.S. PATENT DOCUMENTS

| | | | | |
|---|---|---|---|---|
| 1,963,004 A | | 6/1934 | Tucker | 2/127 |
| 2,025,485 A | | 12/1935 | Tucker | 2/127 |
| 2,087,532 A | | 7/1937 | Shepherd | 2/127 |
| 2,099,520 A | * | 11/1937 | Hendycy | 2/129 |
| 2,101,380 A | * | 12/1937 | Alston | 2/129 |
| 2,396,842 A | * | 3/1946 | Franklin | 2/129 |
| 2,996,723 A | * | 8/1961 | Ainslie | 2/129 |
| 3,148,377 A | * | 9/1964 | Anderson | 2/129 |
| 3,328,808 A | | 7/1967 | Ambrose | 2/127 |
| 3,393,406 A | | 7/1968 | Hollinger | 2/129 |
| 4,937,884 A | * | 7/1990 | Sherman | 2/129 |
| 5,274,853 A | | 1/1994 | Millican | 2/141 |
| 6,081,926 A | * | 7/2000 | Krause et al. | 2/129 |
| 6,212,686 B1 | * | 4/2001 | Krause et al. | 2/129 |

* cited by examiner

*Primary Examiner*—Gloria M. Hale
(74) *Attorney, Agent, or Firm*—Dennis H. Lambert, Esq.

(57) ABSTRACT

A shirt collar having a stretchable neckband made of a woven fabric with at least some of the threads on a bias so that in the event the length of the threads shrinks there is only a negligible reduction in the circumferential size of the collar, and the collar is circumferentially stretchable. In one form of the invention the neckband is made of a non-elastomeric material with a plurality of holes in it which elongate when a circumferential force is applied, resulting in elongation of the neckband. In another form, the threads forming the neckband are kinked so that they are resiliently yieldable in a lengthwise direction. The stitching attaching the neckband to the collar and to the shirt body may be applied in a pattern, e.g., zig-zag or skip stitching, that enables the seams to stretch.

25 Claims, 7 Drawing Sheets

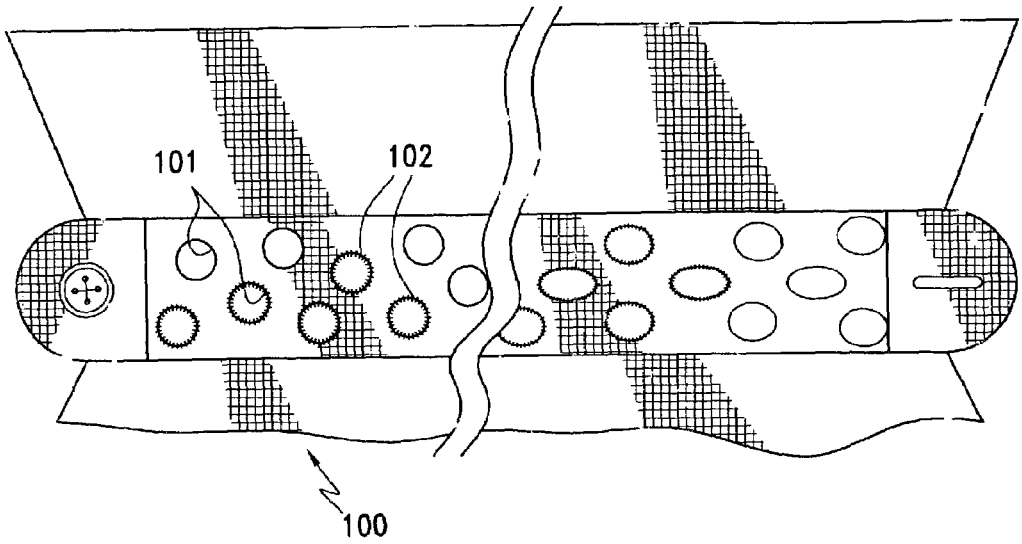
FIG. 18
FIG. 19
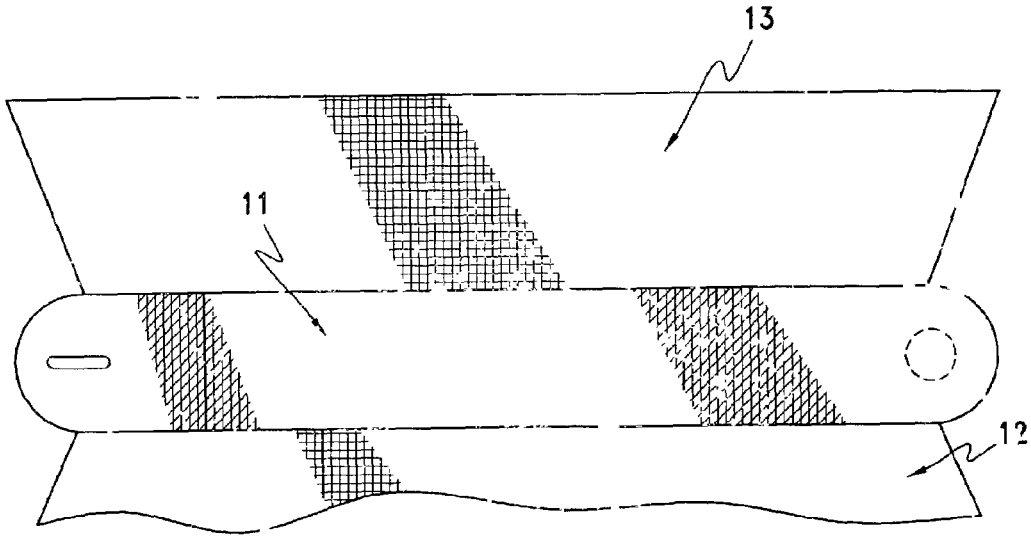
FIG. 20

EXPANDABLE, NO-SHRINK SHIRT COLLAR

This application is a continuation-in-part of application Ser. No. 09/783,853, filed Feb. 15, 2001, now U.S. Pat. No. 6,477,713, which is a continuation-in-part of application Ser. No. 09/366,681, filed Aug. 4, 1999, now U.S. Pat. No. 6,212,686, which is a continuation-in-part of application Ser. No. 09/172,358, filed Oct. 14, 1998, and now U.S. Pat. No. 6,081,926.

BACKGROUND OF THE INVENTION

1. Field of the Invention

This invention relates generally to garments. More particularly, the invention relates to a shirt in which the collar does not shrink noticeably in size when laundered, and in which the collar is expandable circumferentially to enable the collar to adjust to slight variations in neck size, thereby making it more comfortable to wear. The expandable collar of the invention also accommodates a small range of different neck sizes, enabling fewer shirt sizes to be manufactured and inventoried. Further, the expandable collar of the invention is easier to button because of the slight stretch or yield of the material.

2. Description of the Prior Art

Shirts having collars, e.g., dress shirts, are normally sold in sizes based upon the circumference of the collar and the length of the sleeves. Manufacturers presently make shirts with actual neck sizes that are slightly greater than the marked size in order to compensate for shrinkage when the shirt is laundered. Moreover, shirts are typically manufactured with collar sizes varying in half-inch increments, e.g., 15, 15½, 16, 16½ etc. These incremental sizes enable most users to find a comfortable fit, but require a large number of different sizes to be manufactured and inventoried. Moreover, the wearer's neck size may vary slightly during the course of a day, or over some other period of time, and a previously selected neck size may become uncomfortable or inappropriate. Further, even when the shirt fits comfortably, it is sometimes difficult to button the collar button.

In conventional shirts, a neckband having inner and outer panels and an interfacing is sewn between the body of the shirt and the collar. A button and button hole are provided in opposite ends of the neckband to secure the neckband and thus the collar about the neck of the wearer. The weave of the fabric of the neckband and the collar is placed or oriented so that the weft runs circumferentially and the warp runs perpendicularly thereto. There is very little, if any, yield of this material in a circumferential direction. When the shirt is laundered, the threads typically shrink in length by three to five percent. Consequently, in a shirt having a sixteen inch neck size, for example, the shrinkage in a circumferential direction can be greater than one-half inch. This makes the shirt uncomfortable or impossible to wear.

Various solutions to the problem have been offered in the prior art. For instance, in U.S. Pat. No. 2,396,842 to Franklin, reinforced stitching is placed in the neckband during manufacture of the shirt, with the stitching extending generally transversely of the length of the neckband, and resembling the stitching around a button hole. If the collar becomes too tight for some reason, the fabric in the area bordered by the stitching can be cut, thereby enabling the neckband to expand slightly, effectively increasing the length of the neckband. The opening formed by cutting the material bordered by the reinforced stitching is bottom edges of the neckband remain unaffected. Thus, elongation of the neckband is limited due to the restraining effect of the stitching at the top and bottom edges of the neckband. Moreover, in order for the invention shown in this patent to be operative, it is necessary for the user to cut the fabric bordered by the reinforced stitching.

Other solutions to this problem have been offered by U.S. Pat. No. 2,025,485 to Tucker, U.S. Pat. No. 2,087,532 to Shepherd, U.S. Pat. No. 2,996,723 to Ainslie, U.S. Pat. No. 3,148,377 to Anderson, U.S. Pat. No. 3,328,808 to Ambrose and U.S. Pat. No. 4,937,884 to Sherman. All of these patents rely upon some form of elastic material to permit the circumference of the collar to expand to accommodate to different neck sizes.

U.S. Pat. No. 2,101,380 to Alston discloses a different arrangement, wherein a box pleat is formed completely along the back of the shirt and through the neckband, with an adjustable strap and buckle to enable the pleat to be closed or opened.

U.S. Pat. No. 5,274,853 to Millican discloses another arrangement, wherein multiple fasteners are provided in order to adjust the circumference of the shirt collar, depending upon which fastener is selected.

Many of these prior art arrangements are relatively complicated and expensive to manufacture, and/or require specific action or manipulation by the user, and/or apply a constant compressive force to the neck.

In applicant's prior U.S. Pat. No. 6,212,686, the threads forming both the warp and the weft in the weave of the neckband and collar were placed on a bias, whereby shrinkage in the length of the threads has negligible effect on the circumferential dimension of the collar. Moreover, placement of the threads on a bias enables the fabric to yield or stretch in a circumferential direction. Further, in this patent the edges of the interfacing may be cut in a zig-zag pattern and secured only at the peaks, enabling it to stretch or expand along with the collar. The stitching joining the neckband and the collar can also be in a zig-zag or other pattern so that the stitching itself does not impede stretching of the collar. Although the structure employed in this application would avoid shrinkage, that fact was not recognized at the time.

In applicant's prior U.S. Pat. No. 6,081,926, an expandable collar was accomplished by use of expandable slits in the neckband. Although this approach solved the "comfort" problem, it requires an additional manufacturing step, moreover, if the collar is raised or folded up, the slits are noticeable to the wearer and those near him. This patent did not teach any feature that would avoid shrinkage.

The present invention provides a simple and economical means associated with the neckband of a shirt to avoid shrinkage of the neckband in a circumferential direction when the shirt is laundered, and also to enable the neckband to yield in a circumferential direction to compensate for an increase or decrease in the neck size of the user, and to enable a shirt manufactured in a single neck size to comfortably fit persons having different neck sizes, without producing a noticeably different appearance to the wearer or those near him. Additionally, a stretchable fabric can be used in the manufacture of the neckband that is especially soft and comfortable when placed next to the skin, and without altering manufacturing techniques or affecting the appearance of the shirt.

SUMMARY OF THE INVENTION

Simple and economical means is associated with the neckband in the present invention, operative to prevent noticeable shrinkage of the neckband when the shirt is laundered, and to automatically effectively adjust the length of the neckband to a small range of different neck sizes, whereby fewer incremental sizes need to be manufactured and inventoried, shirts can be marketed with the actual neck size marked on the label, and whereby the shirt remains comfortable to wear even after it has been laundered and even when the neck size of the wearer varies slightly after purchase of the shirt, all without requiring additional manufacturing steps or producing an appearance that is noticeably different to the customer.

The foregoing is achieved by using a circumferentially yieldable fabric in the manufacture of at least the neckband to minimize or eliminate circumferential shrinkage when the shirt is laundered, and that enables elongation and contraction of the collar and neckband in a circumferential direction.

The yieldable fabric may comprise a fabric in which the threads forming the warp and weft are both placed on a bias, as in applicant's prior U.S. Pat. No. 6,212,686, or only the threads that would normally run circumferentially can be placed on a bias, or the threads can be kinked so that they will stretch or elongate when a force is applied to them, or holes can be formed in the fabric so that when a force is applied to the fabric the holes can elongate and enable the fabric to yield or stretch. The inner and outer panels of the neckband can both be made of the same stretchable, non-shrinking material, or the inner panel can be made of one material and the outer panel made of another material. Similarly, the interfacing, if attached to either or both the inner and outer panels, can be made of a stretchable material.

It is not necessary to make the collar of a stretchable, non-shrinking material, since the neckband is the part that is secured about the neck of the wearer. Thus, the present invention is concerned primarily with making only the neckband stretchable and non-shrinking, although the same principles could be applied to the collar, if desired.

With the invention, even though shrinkage or shortening of the threads comprising the neckband may occur along the length of the threads when the shirt is laundered, the arrangement of the threads on a bias results in negligible shrinkage of the neckband in a circumferential direction. Moreover, when tension or force is applied along the length of the neckband, the fabric of the neckband is enabled to expand or stretch, effectively lengthening the neckband.

Similarly, any interfacing or stiffening material that is placed in the collar and/or neckband can be oriented so that the weave is on a bias, whereby any shrinkage in the length of the threads has a negligible effect in a circumferential direction of the neckband, and the material can flex or stretch along with the material of the collar and/or neckband. The interfacing can be made of any stretchable material.

In some shirts, the collar interfacing is stitched at one edge in the seam joining the neckband and collar. If the interfacing is not made of a stretchable material, or not oriented with its weave on a bias, this edge can be cut with a zig-zag pattern and positioned so that the stitching secures only at the peaks. Thus, even if shrinkage of the interfacing occurs, and even if a stiff, non-stretchable interfacing is used, the collar and neckband will not shrink in a circumferential direction, and they are still able to stretch.

The stitching joining the collar and neckband can be done on a zig-zag, or skip stitching can be used, whereby any shrinkage in the threads of the stitching will have a negligible effect on the circumferential size of the collar, and the stitching itself can yield or stretch in a longitudinal direction when tension or force is applied circumferentially to the collar. However, this is only important if the collar is also made of a stretchable, non-shrinking material. Otherwise, if only the neckband is made so that it can stretch circumferentially, and not appreciably shrink in a circumferential direction, conventional attachment of the collar to the neckband, and of the neckband to the shirt body, can be utilized.

A shirt made in accordance with the invention does not cost any more than a shirt made conventionally, and requires little or no change in the manufacturing procedure. It is necessary only to use a yieldable fabric in the manufacture of the neckband. For instance, in that form of the invention wherein the threads forming the fabric of the neckband are placed on a bias, it is necessary only to lay the material that forms the neckband so that the weave is on a bias when the material is cut and sewn in the shirt. If desired, stitching can be used that enables the stitched seam to stretch or elongate when force is applied to it. For example, the stitching can be applied in a zig-zig or sinusoidal pattern, or skip stitching or other form of stitching can be used.

Fewer sizes need to be manufactured and stocked when shirts are made according to the invention, and the actual size of the collar can be the same as marked. For example, shirts can be made in sizes 15–15½, 16–16½, 17–17½, etc., rather than in sizes 15, 15½, 16, 16½, 17, 17½, etc., thereby eliminating every other half-size that is currently manufactured and stocked. This can result in lower cost to both the manufacturer and the retailer Further, a shirt made in accordance with the invention does not present a noticeably different appearance to the customer, and is easier to button than a conventional shirt.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 18 is a fragmentary front view in elevation, similar to FIG. 16, of a ninth embodiment, wherein the threads forming the fabric of the neckband are arranged conventionally in a "north-south" and "east-west" direction, but a plurality of large holes stitched around their border are formed in the fabric to make the neckband yieldable in a circumferential direction;

FIG. 19 is a fragmentary schematic front view in elevation, similar to FIG. 18, showing the holes elongated as they would be when a circumferential force is applied to the neckband;

FIG. 20 is a fragmentary back view in elevation of a shirt collar according to the invention, showing the outer or back panel of the neckband.

DETAILED DESCRIPTION OF THE PREFERRED EMBODIMENTS

Figure 1:
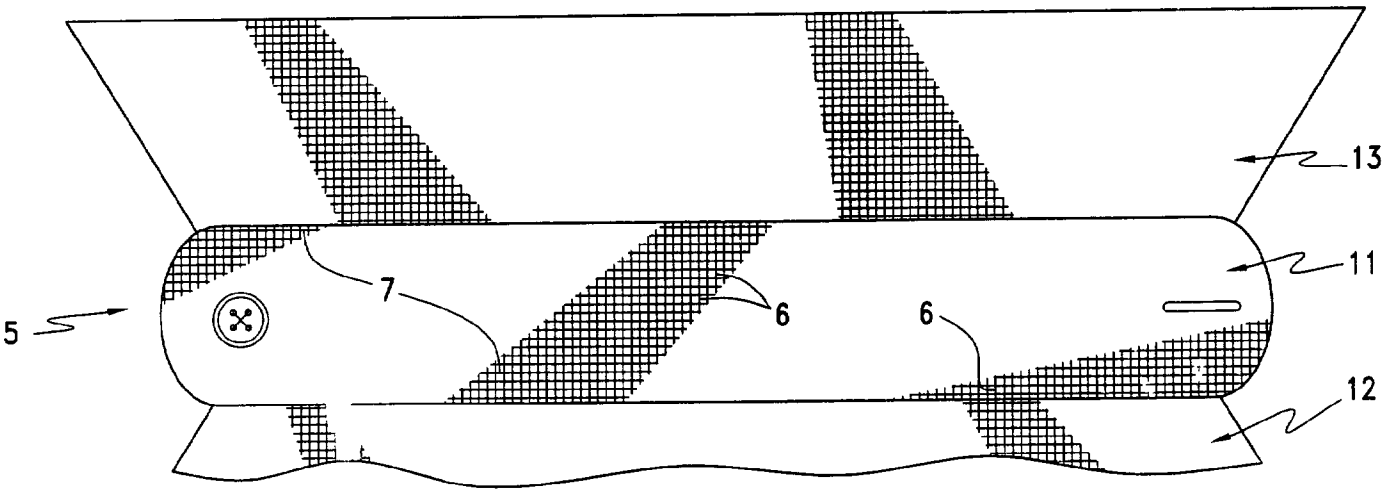
FIG. 1 (PRIOR ART)
FIG. 1 is a fragmentary schematic view in elevation of a prior art shirt collar, showing the circumferential direction of the threads.

Referring more specifically to the drawings, a prior art shirt is indicated generally at 5 in FIG. 1. In this shirt, the warp and weft threads 6 and 7 forming the fabric of the neckband 11 run "north-south" and "east-west", or circumferentially and perpendicular to the circumference, respectively. With this arrangement, if the threads shrink when the shirt is laundered, the length of the threads can decrease from three to five percent. This can result in a reduction in circumference of the collar of more than one-half inch.

Figure 2:
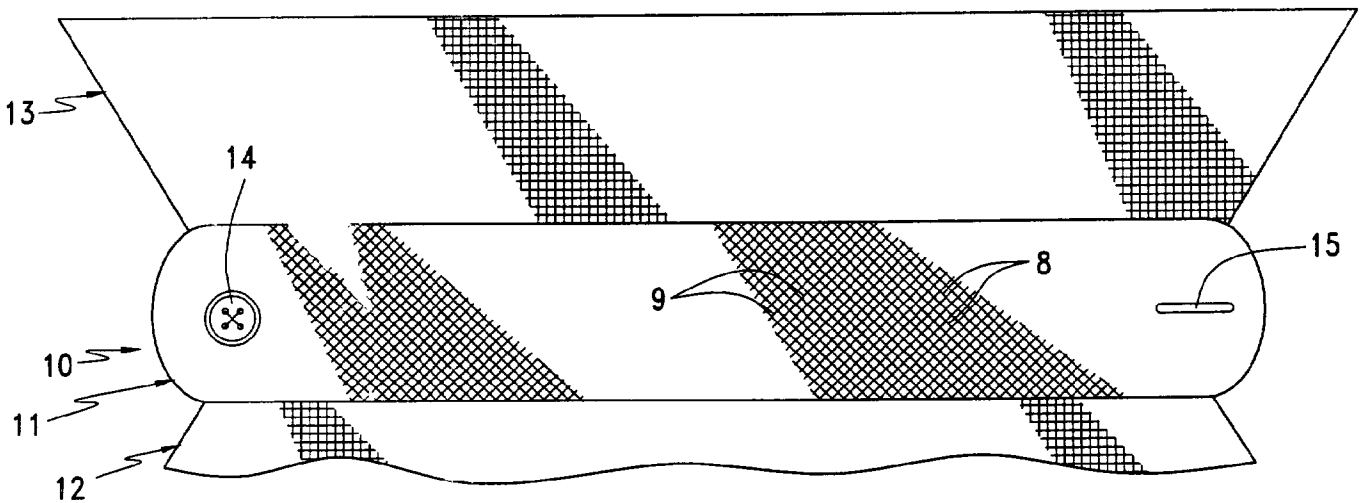
FIG. 2 is a view similar to FIG. 1, showing a first embodiment of collar according to the invention, wherein both the warp and the weft threads of both the neckband and the collar are arranged on a bias.

A shirt incorporating the invention is indicated generally at 10 in FIG. 2. In this shirt, the warp and weft threads 8 and 9 forming the fabric of the neckband 11 are placed on a bias, i.e., rather than run north-south and east-west, the threads extend at approximately 45° to the circumference. The neckband is sewn to the body 12 of the shirt, and a collar 13 is sewn to the neckband. The threads of the collar need not be placed on a bias, but may extend conventionally in a north-south and east-west direction.

A collar button 14 and button hole 15 in opposite ends of the neckband are utilized to hold the collar in closed position about the neck of the wearer.

The present invention differs significantly from conventional shirts in the orientation of the weave of the fabric forming the neckband to minimize or eliminate shrinkage, and in the provision of means to insure that the collar can expand or adapt to slightly different neck sizes. This enables shirts to be made and stocked in fewer sizes, and insures that a shirt will remain comfortable to wear even when the neck size of the wearer changes slightly, or in the event that the shirt should shrink when laundered.

With the threads forming the material of the neckband extending at an angle to the longitudinal axis or circumferential direction of the collar, the material will not shrink noticeably in a circumferential direction even if the threads shrink in length, and the neckband is enabled to flex or stretch when force is applied in a direction parallel to the longitudinal axis or circumference of the collar. In a preferred embodiment, the threads forming the weave extend at 45° to the longitudinal axis of the collar, but the broad objective of the invention can be achieved if the threads extend at an angle in the range of from about 10° to about 80° relative to the longitudinal axis of the collar. Clearly, however, less shrinkage occurs in a circumferential direction, and greater flexibility is achieved when the weave is on a bias of about 45°.

In conventional shirts, the material of the collar and neckband is oriented so that the weave is orthogonal relative to the longitudinal axis or circumferential direction of the collar. In other words, the threads forming the material extend parallel and perpendicular, respectively, to the longitudinal axis of the collar. See FIG. 1. In this orientation, if the length of the threads decreases due to shrinkage, the circumference of the collar also decreases the same amount.

Further, the material does not flex or stretch any significant amount when force is applied, since the force is in a direction parallel to the direction of the threads.

In the invention, in addition to orienting the material of the neckband so that the weave is at an angle relative to the longitudinal axis of the collar, the seams that secure the collar and neckband together, and that secure the neckband to the body of the shirt, may be formed by using stitching that enables the seams to stretch or expand in the circumferential direction of the collar.

Figure 3:
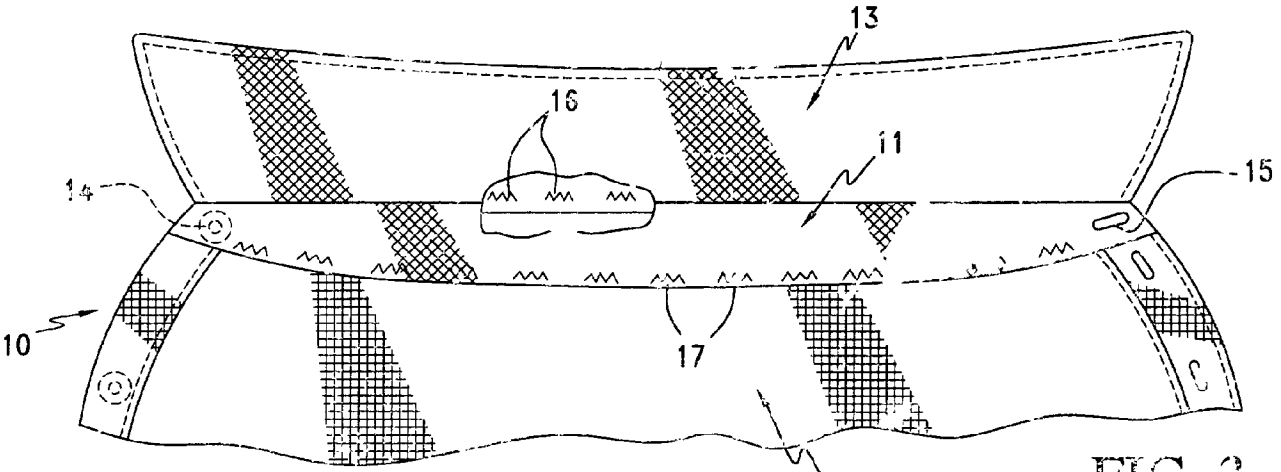
FIG. 3 is a fragmentary front view in elevation of the FIG. 2 embodiment of a shirt collar utilizing the invention, with portions broken away, looking at the inside of the shirt and with the shirt opened up and the collar in an upwardly extended position, wherein a zig-zag skip stitching is used to secure the collar to the neckband, and the neckband to the body of the shirt.

Further, the threads in the material forming the collar may be arranged on a bias as shown in FIG. 3, if desired. However, this is not necessary, and the weave or threads of the collar may extend north-south and east-west, as shown in FIG. 2.

Figure 8:
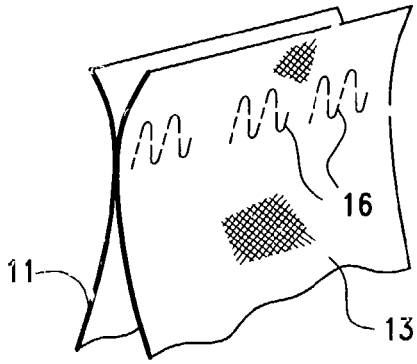
FIG. 8 is a view similar to FIG. 5, showing a fourth form of stitching for joining the collar and neckband, wherein the stitching is an interrupted zig-zag pattern.
Figure 9:
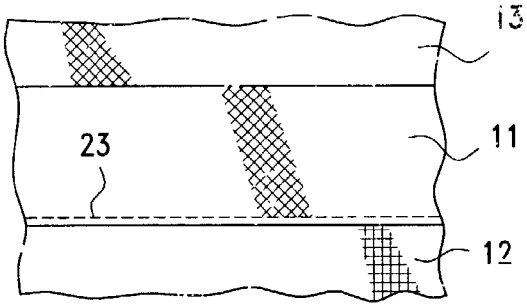
FIG. 9 is a fragmentary view of a portion of a shirt collar, neckband, and shirt body, showing a straight stitch joining the neckband to the shirt body.
Figure 10:
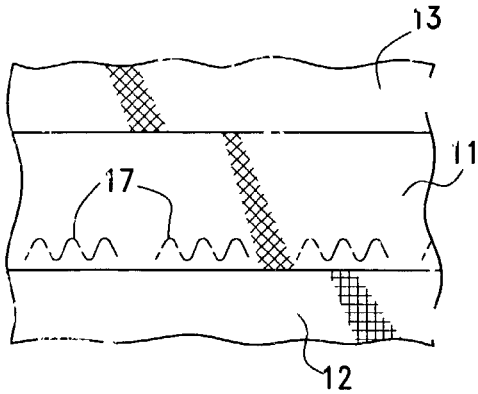
FIG. 10 is a fragmentary view similar to FIG. 9, showing an interrupted zig-zag stitching joining the neckband and shirt body.

As depicted in FIGS. 3, 8 and 10, the stitching 16 securing the collar 13 to the neckband 11, and the stitching 17 securing the neckband to the body 12 of the shirt, may comprise an interrupted zig-zag stitch. This style of stitching, together with the orientation of the material of the neckband on a bias, insures that the collar does not shrink noticeably in a circumferential direction when it is laundered, and the collar can expand or stretch in a circumferential direction when force is applied to it. The extent of expansion is substantial, with more than one inch of expansion being possible in a size sixteen collar.

Many dress shirts have interfacing between the inner and outer layers of the collar, and/or between the inner and outer layers of the neckband, and this interfacing can be flexible or stiff, and can be glued to the inner layer of the collar, or stitched in the seam that joins the collar to the neckband. The interfacing in the neckband, when present, generally comprises the same material that the body of the shirt is made of.

Figure 4:
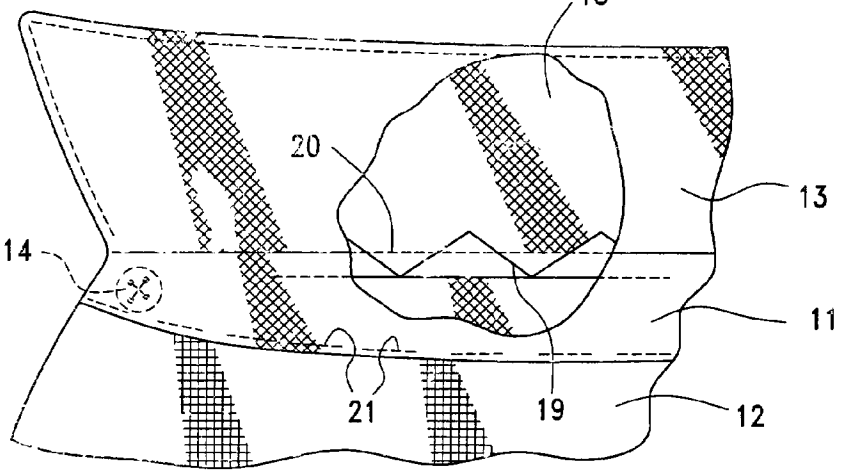
FIG. 4 is a slightly enlarged fragmentary front view of the collar of FIG. 3, showing an alternate form of stitching between the collar and the neckband, and showing the zig-zag cut on the bottom edge of the interfacing in the collar.

FIG. 4 depicts an arrangement in which a layer of interfacing 18 extends between the inner and outer layers of the collar. In the embodiment shown, the interfacing is made of an open weave, mesh-like material, oriented on a bias, and with the bottom edge 19 scalloped or cut in a zig-zag pattern so that only the peaks of the edge are stitched in the seam between the collar and neckband. The stitching 20 that secures the collar to the neckband, and the interfacing at its scalloped lower edge, is shown as an uninterrupted straight stitch. However, it should be understood that any other suitable form of stitching could be employed. In this regard, it should be noted that the uninterrupted straight stitching will permit adequate stretching of the seam, but an interrupted stitch, or a stitch applied in a zig-zag pattern, will permit greater stretching of the collar. The stitching 21 shown connecting the neckband to the body of the shirt in this figure is an interrupted straight stitch, for example.

Figure 5:
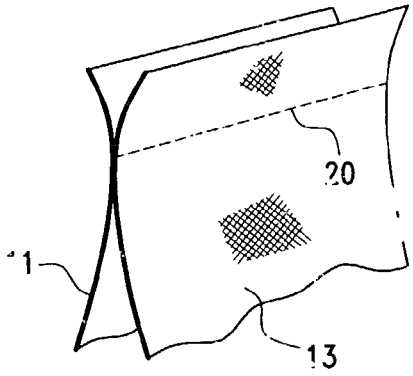
FIG. 5 is a fragmentary perspective view of the seam between the collar and neckband, with the collar and neckband shown in an inside-out position, and showing an embodiment of the invention wherein a straight stitch is used to join the material of the collar and neckband.
Figure 6:
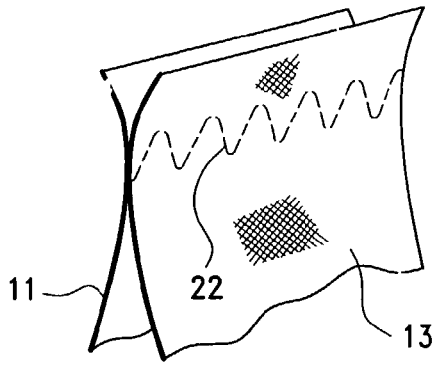
FIG. 6 is a view similar to FIG. 5, showing a second form of stitching for joining the collar and neckband, wherein the stitching is in a zig-zag pattern.
Figure 7:
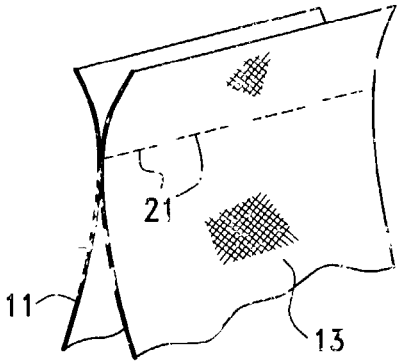
FIG. 7 is a view similar to FIG. 5, showing a third form of stitching for joining the collar and neckband, wherein the stitching is an interrupted straight stitching, or skip stitch.

Alternate forms of stitching are shown in FIGS. 5, 6, 7 and 9. FIGS. 5, 6 and 7 show the neckband 11 and collar 13 turned inside-out for forming the seam between them, and in FIG. 5 the stitching 20 comprises an uninterrupted straight stitch. In FIG. 6, the stitching 22 comprises an uninterrupted zig-zag stitch; in FIG. 7 the stitching 21 comprises an interrupted straight stitch; and in FIG. 9 the stitching 23 for joining the neckband to the body of the shirt comprises an uninterrupted straight stitch.

Figure 11:
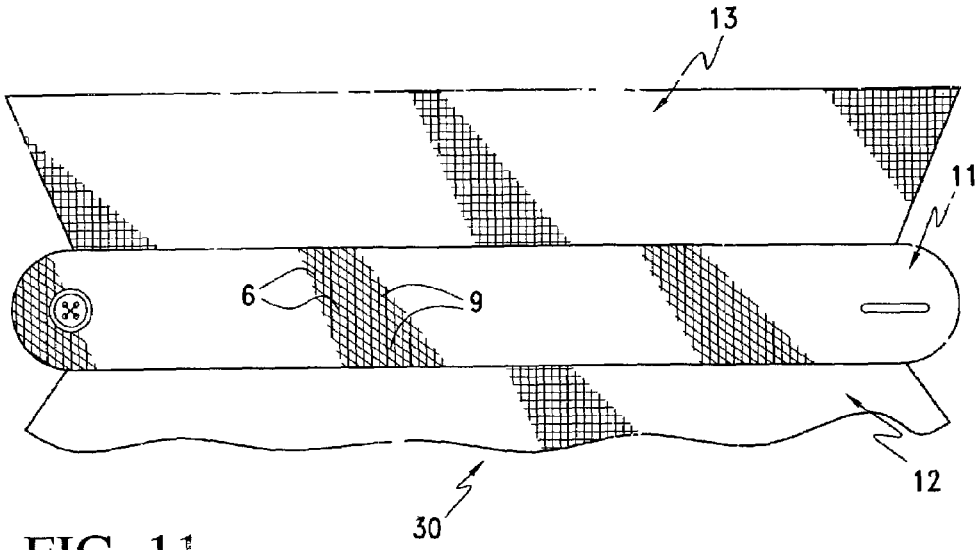
FIG. 11 is a fragmentary schematic front view in elevation of a second embodiment of a shirt collar according to the invention, wherein the warp and weft threads forming the fabric of the collar and the shirt body, respectively, are arranged conventionally, i.e., in a "north-south" direction, or circumferentially and perpendicularly to the circumference of the shirt collar, and one of the warp and weft sets of threads in the neckband are arranged on a bias, with the other set of threads extending perpendicularly to the circumference of the neckband.

A second embodiment of the invention is shown at 30 in FIG. 11. In this form of the invention, the warp threads 6 of the neckband extend perpendicular to the circumference of the neckband, but the weft threads 9 extend diagonally, thus enabling the neckband to stretch in a circumferential direction and resulting in negligible circumferential shrinkage. The fabric forming the shirt body 12 and collar 13 may be of conventional construction, with the threads extending in "north-south" and "east-west" directions.

Figure 12:
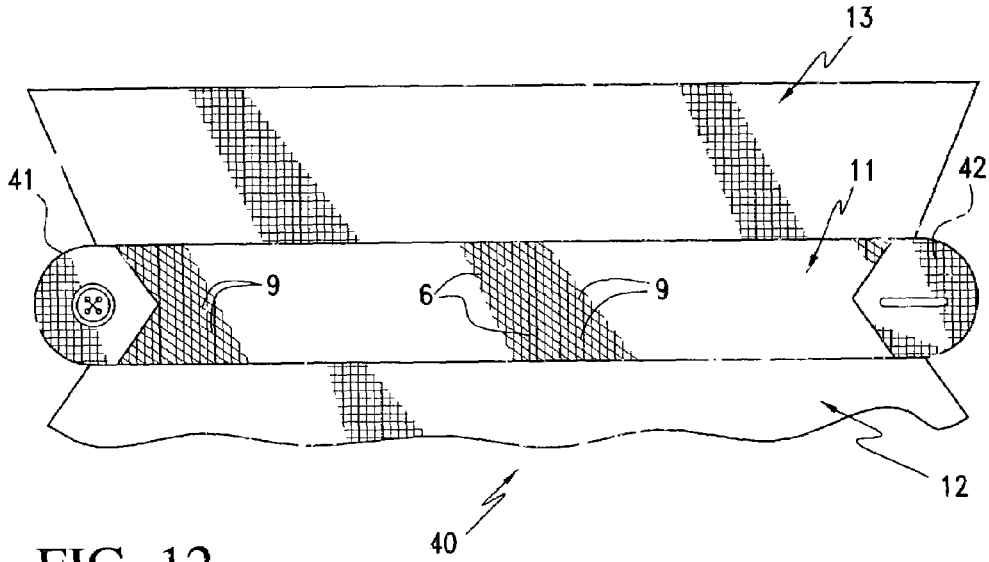
FIG. 12 is a view similar to FIG. 11 of a third embodiment, wherein "tabs" of conventional shirt fabric material are attached to the opposite ends of the neckband.

A third embodiment is shown at 40 in FIG. 12. In this form of the invention, the fabric has the same construction as in the FIG. 11 embodiment, but small "tabs" 41 and 42 of conventional weave are attached to the ends of the neckband where the collar button and button hole are applied. These tabs are visible when a tie is not being worn, or when it is loosened, and by making them of conventional material the appearance of the shirt collar is conventional, but the body of the neckband is stretchable to achieve the beneficial attributes discussed above.

Figures 13, 14, 15:
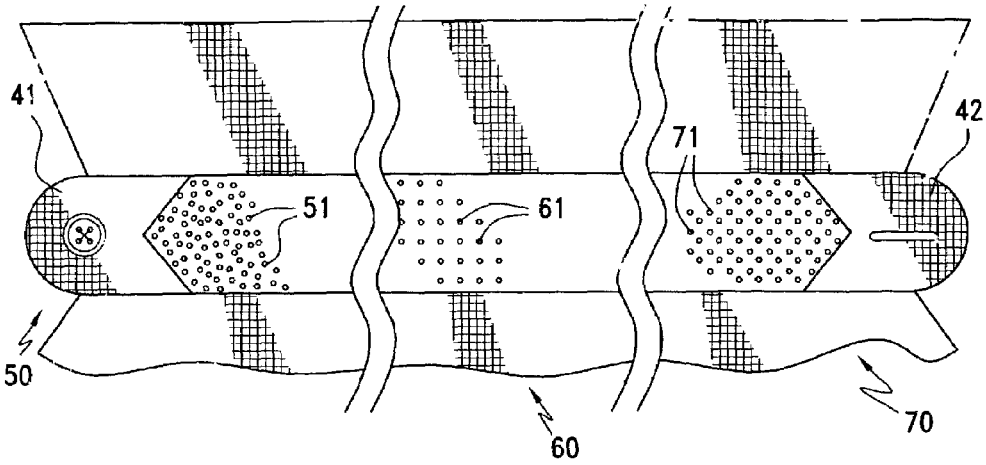
FIG. 13 is a fragmentary front view in elevation, similar to FIG. 12, of a fourth embodiment, wherein the material of the neckband has a plurality of small holes formed randomly therein to make it yieldable in a circumferential direction.
FIG. 14 is a fragmentary front view in elevation, similar to FIG. 13, of a fifth embodiment, wherein the material of the neckband has a plurality of small holes formed therein in a regular rectangular pattern to make it yieldable in a circumferential direction.
FIG. 15 is a fragmentary front view in elevation, similar to FIG. 14, of a sixth embodiment, wherein the material of the neckband has a plurality of small holes formed therein in a regular diagonal pattern to make it yieldable in a circumferential direction.

A fourth embodiment is shown at 50 in FIG. 13, wherein the material of the neckband has a plurality of randomly arranged small holes 51 therein. These holes create a net-or mesh-like structure that can yield when a force is applied to it. In this form of the invention, the material can comprise a thermoplastic material, whereby the holes can be formed by a heated implement or laser or other means. Tabs 41 and 42 can be applied to the ends of the neckband, as in the above-described form of the invention, to give a conventional appearance.

A fifth embodiment is shown at 60 in FIG. 14. This form of the invention is essentially identical to the FIG. 13 embodiment, except that the holes 61 are arranged in a regular rectangular pattern.

A sixth embodiment is shown at 70 in FIG. 15. Again, this form of the invention is essentially the same as the FIGS. 13 and 14 embodiments, except that the holes 71 are arranged in a regular diagonal pattern.

Figures 16, 17:
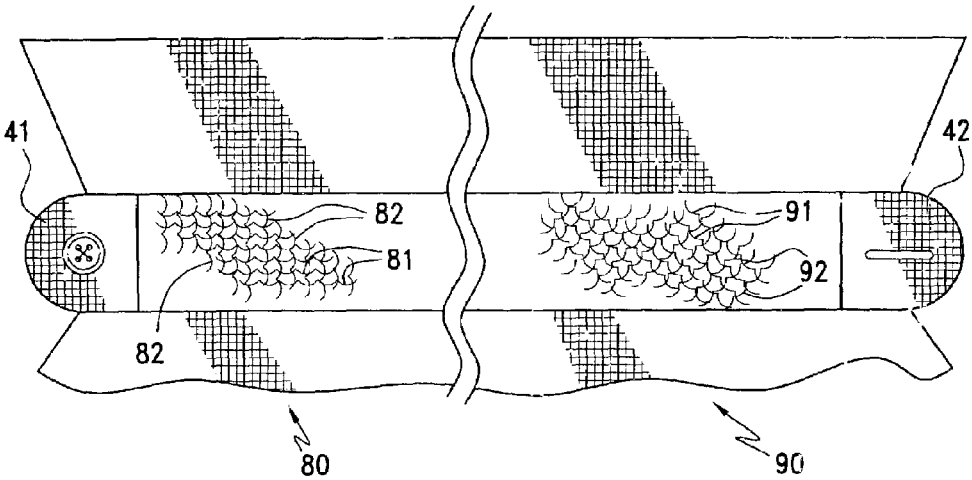
FIG. 16 is a fragmentary front view in elevation, similar to FIG. 13, of a seventh embodiment, wherein the threads forming the fabric of the neckband are arranged conventionally in a "north-south" and "east-west" direction, but are kinked so that they are stretchable or elongatable to make the neckband yieldable in a circumferential direction.
FIG. 17 is a fragmentary front view in elevation, similar to FIG. 16, of an eighth embodiment, wherein one of the warp and weft sets of threads forming the fabric of the neckband are arranged conventionally in a "north-south" direction, but the other set is arranged on a diagonal, and both sets are kinked so that they are stretchable or elongatable to make the neckband yieldable in a circumferential direction.

A seventh embodiment is shown at 80 in FIG. 16. In this form of the invention, the threads 81 and 82 forming the warp and weft of the fabric of the neckband are kinked so that they easily elongate when a tensile force is applied. It will be noted that the threads extend in a "north-south" and "east-west" direction, but due to the ability of the threads to elongate, this arrangement is satisfactory. Tabs 41 and 42 may be applied to the ends of the neckband in this embodiment.

An eighth embodiment is shown at 90 in FIG. 17. In this form of the invention, the threads 91 and 92, in addition to being kinked, extend diagonally.

A ninth embodiment is shown at 100 in FIG. 18. In this form of the invention, a plurality of large holes 101 are made in the fabric of the neckband, and stitching, much like the stitching around a button hole, is placed around the edges of the holes to prevent unraveling of the threads. The threads forming the fabric can be oriented "north-south" and "east-west", or on a diagonal, as in the previously described forms of the invention. The yieldability of the fabric in this form of the invention relies upon the elongation of the holes as tension is applied circumferentially to the neckband. See FIG. 19, which shows how the holes elongate to enable "stretching" of the neckband. It will be noted that those holes nearer the top and bottom edges of the neckband, where they join the conventional shirt body and collar, do not elongate as much because of the resistance to stretching of the adjacent shirt body and collar.

FIG. 20 is a rear view in elevation of a shirt collar embodying the novel neckband of the present invention, showing how the outer panel of the neckband can be made of a material that is not visually distinguishable from the conventional shirt body and collar.

Figure 21:
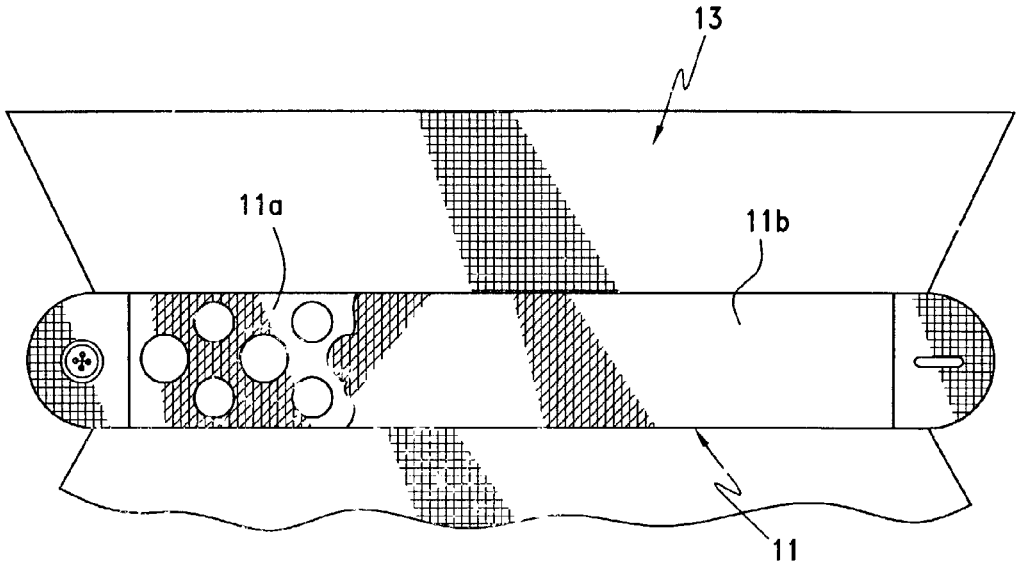
FIG. 21 is a fragmentary, schematic front view in elevation of a shirt collar according to the invention, with the inner panel of the neckband broken away to reveal the outer or back panel, and depicting how a possibly visually undesirable inner panel can be used in combination with an outer panel that is visually conventional.

FIG. 21 is a schematic front view in elevation, with a portion of the inner panel 11*a* of the neckband 11 broken away to reveal a portion of the outer panel 11*b*, depicting how an inner panel made of a material that preferably would normally not be visible when the shirt is worn can be used in combination with an outer panel that has a conventional appearance.

While a variety of stretchable and non-shrinking materials have been disclosed herein for use in the manufacture of the neckband of the invention, it should be understood that other variations may exist. For instance, a soft and comfortable material such as that used in the manufacture of cotton T-shirts may be used at least as the inner ply or layer in the neckband of the invention, or as both the inner and outer ply. However, it is preferred that elastomeric materials, such as rubber, for example, not be used, since they tend to apply a constant tensile force to the neckband, which can be uncomfortable.

The invention insures that no more than negligible shrinkage will occur in a circumferential direction, and enables the collar size to increase from about one-half of an inch up to about one inch when a force is applied thereto in a circumferential direction. This resistance to shrinkage and ability to stretch enables fewer sizes to be manufactured and stocked, makes the shirt more comfortable to wear, and makes it easier to button. Moreover, these benefits are accomplished without any noticeable change in the appearance of the shirt.

Manufacturers and/or retailers may find the invention to be desirable because it could enable them to stock fewer sizes, thereby making room for more styles. This would also reduce the number of shirts in odd sizes that are required to be stocked but that may not sell. Further, the invention may be a value-added feature, enabling the shirt to be priced higher than conventional shirts.

While particular embodiments of the invention have been illustrated and described in detail herein, it should be understood that various changes and modifications may be made to the invention without departing from the spirit and intent of the invention as defined by the scope of the appended claims.

What is claimed is:

1. In a shirt having a shirt body, an elongate neckband, and a collar, wherein the neckband is adapted to encircle the neck of a wearer and has upper and lower edges connected to the collar and to the shirt body, respectively, and a fastening means is on the ends of the neckband for securing the neckband and thus the collar circumferentially about the neck of a wearer, the improvement comprising:

a stretchable neckband made of a woven fabric material other than an elastomeric material, arranged so that the weave thereof is on a bias relative to the circumferential direction of the neckband, and which yields in at least a circumferential direction when a tensile force is applied thereto in a circumferential direction, and wherein the circumferential size of the neckband is only negligibly affected in the event of shrinkage of the material comprising the neckband.

2. A shirt collar as claimed in claim 1, wherein:

the woven fabric is formed of warp and weft threads that extend at an angle between about 10° and about 80° relative to the circumferential direction of the neckband.

3. A shirt collar as claimed in claim 2, wherein:

the threads forming the weft and warp of the material of the neckband extend at an angle of about 45° relative to the circumferential direction of the neckband.

4. A shirt collar as claimed in claim 2, wherein:

the collar is also formed of warp and weft threads, and the threads forming the warp and weft of the material of both the collar and the neckband extend at an angle of about 45° relative to the longitudinal axis of the neckband.

5. A shirt collar as claimed in claim 2, wherein:

the neckband and collar are attached at adjacent edges by stitching that forms a seam, said stitching enabling said seam to stretch or elongate when a tensile force is applied thereto.

6. A shirt collar as claimed in claim 5, wherein:

the neckband and body of the shirt are attached at adjacent edges by stitching that forms a seam, said stitching enabling said seam to stretch or elongate when a tensile force is applied thereto.

7. A shirt collar as claimed in claim 6, wherein:

the neckband and collar are attached at adjacent edges by stitching that forms a seam, said stitching enabling said seam to stretch or elongate when a tensile force is applied thereto.

8. A shirt collar as claimed in claim 7, wherein:

the stitching comprises skip stitching, wherein the threads forming the stitch are interrupted at predetermined locations.

9. A shirt collar as claimed in claim 7, wherein:

the stitching comprises zig-zag stitching.

10. A shirt collar as claimed in claim 9, wherein:

the zig-zag stitching is interrupted at predetermined locations.

11. A shirt collar as claimed in claim 7, wherein:

the neckband and body of the shirt are attached at adjacent edges by stitching that forms a seam, said stitching enabling said seam to stretch or elongate when a tensile force is applied thereto.

12. A shirt collar as claimed in claim 11, wherein:

the stitching comprises skip stitching, wherein the threads forming the stitch are interrupted at predetermined locations.

13. A shirt collar as claimed in claim 11, wherein:

the stitching comprises zig-zag stitching.

14. A shirt collar as claimed in claim 13, wherein:

the zig-zag stitching is interrupted at predetermined locations.

15. A shirt collar as claimed in claim 3, wherein:

the neckband is formed of inner and outer panels of material that stretches in a circumferential direction and which shrinks only negligibly or not at all in at least a circumferential direction.

16. A shirt collar as claimed in claim 15, wherein:

a layer of interfacing material is interposed between the inner and outer panels of the neckband.

17. A shirt collar as claimed in claim 16, wherein:

the neckband and collar are stitched together along a seam; and an edge of the interfacing material is stitched into the seam between the collar and neckband, said edge being cut in a zig-zag pattern forming peaks on the edge, and said stitching extends across said peaks, whereby the edge of the interfacing is secured in said seam only at spaced locations.

18. A shirt collar as claimed in claim 1, wherein:

the woven fabric is formed of warp threads and weft threads, with the warp threads running perpendicular to the circumferential direction of the collar, and the weft threads extending on a bias relative to the circumferential direction of the collar.

19. A shirt collar as claimed in claim 1, wherein:

the neckband is formed of inner and outer panels of material that stretches in a circumferential direction and which shrinks only negligibly or not at all in at least a circumferential direction.

20. A shirt collar as claimed in claim 1, wherein:

tabs are affixed to opposite ends of the neckband, and said fastening means is in said tabs.

21. A shirt collar as claimed in claim 20, wherein:

said tabs are formed of a woven material having warp threads and weft threads, with the warp threads running perpendicular to the circumferential direction of the collar and the weft threads running parallel to the circumferential direction of the collar.

22. A shirt collar as claimed in claim 1, wherein:

the woven fabric is formed of warp threads and weft threads, and at least the weft threads extending on a bias relative to the circumferential direction of the collar and comprising a kinked thread that elongates under tension.

23. A shirt collar as claimed in claim 1, wherein:

the neckband is formed of inner and outer panels of material that stretches in a circumferential direction and which shrinks only negligibly or not at all in at least a circumferential direction;

said inner and outer panels each being formed of a woven fabric material comprising warp threads and weft threads, the warp threads and weft threads of at least the outer panel extending at an angle between about 10° and about 80° relative to the circumferential direction of the neckband; and a plurality of holes formed through the inner panel, said holes elongating in a circumferential direction when a tensile force is applied circumferentially to the neckband, whereby the neckband is enabled to elongate when a circumferential force is applied to it.

24. A shirt collar as claimed in claim 23, wherein:

at least the weft threads in the inner panel extend at a bias relative to the circumferential direction of the neckband.

25. A shirt collar as claimed in claim 1, wherein:

the collar is made of a woven fabric material other than an elastomeric material, arranged so that the weave thereof is on a bias relative to the circumferential direction of the neckband, and which yields in at least a circumferential direction when a tensile force is applied thereto in a circumferential direction.

* * * * *